United States Patent [19]

Gongwer

[11] 4,137,709

[45] Feb. 6, 1979

[54] TURBOMACHINERY AND METHOD OF OPERATION

[75] Inventor: Calvin A. Gongwer, Glendora, Calif.

[73] Assignee: Innerspace Corporation, Glendora, Calif.

[21] Appl. No.: 737,065

[22] Filed: Nov. 1, 1976

Related U.S. Application Data

[62] Division of Ser. No. 654,925, Feb. 3, 1976, Pat. No. 4,055,947.

[51] Int. Cl.[2] ..... B63H 11/00; B63H 11/02

[52] U.S. Cl. ..... 60/204; 60/221; 415/1; 415/213 C

[58] Field of Search ..... 60/201, 204, 221, 222, 60/269; 115/11, 19, 16; 415/182, 213 C, 1; 416/223, 228

[56] References Cited

U.S. PATENT DOCUMENTS

| | | | |
|---|---|---|---|
| B 380,014 | 1/1975 | Glenn et al. | 415/213 |
| 1,696,776 | 12/1928 | Menge | 415/182 |
| 2,123,657 | 7/1938 | Monk | 415/182 |
| 2,847,941 | 8/1958 | Jackson | 415/213 |
| 2,948,111 | 8/1960 | Nelson | 60/269 |
| 3,146,939 | 9/1964 | Schlumbohm | 415/90 |
| 3,168,235 | 2/1965 | Valdi | 415/213 |
| 3,230,702 | 1/1969 | Soulez-Lariviero et al. | 60/269 |
| 3,416,725 | 12/1968 | Bohanon | 416/228 |
| 3,464,357 | 9/1969 | Duport et al. | 115/14 |
| 3,487,805 | 1/1970 | Satterthwaite et al. | 60/221 |

*Primary Examiner*—Louis J. Casaregola
*Attorney, Agent, or Firm*—Lyon & Lyon

[57] ABSTRACT

Axial flow turbomachinery having an impeller with a plurality of contoured blades mounted within a diffuser throat and about a central rotatable hub. This blade shape is defined by the ratio of the blade root and tip chords to the minimum midsection blade chord, which is between about 1.25 and about 2.25. The ratio of blade pitch at the root and tip sections as compared with the blade midsection pitch is preferably between about 1.0 and about 1.4.

This configuration of a preferred diffuser is described by the following relationship:

$$\frac{A_x}{A_o} = \left[\left(1 - \left(\frac{A_t}{A_o}\right)^{\frac{n}{2}}\right)\frac{x}{l} + \left(\frac{A_t}{A_o}\right)^{\frac{n}{2}}\right]^{-\frac{2}{n}}$$

Where $A_t$ is the diffuser cross-sectional area at the diffuser throat, $A_o$ is the diffuser cross-sectional area at the outlet, l is the diffuser length from the diffuser throat to the diffuser outlet, x is a distance along the diffuser measured from the diffuser throat toward the diffuser outlet, $A_x$ is the diffuser cross-sectional area x distance from the diffuser throat and n is a value between about 2 and about 4. The thruster diffuser or venturi throat may be provided with a curvilinear surface whose radius as compared with the throat radius is between about 0.2 and 1.0. In operation, the diffuser imparts an increased pressure head at the blade tip and root sections and may be reversably operated.

9 Claims, 6 Drawing Figures

TURBOMACHINERY AND METHOD OF OPERATION

This is a division, of application Ser. No. 654,925, filed 2-3-76 (U.S. Pat. No. 4,055,947).

BREIF DESCRIPTION OF THE INVENTION

1. Field of the Invention

This invention relates to improved axial-flow turbomachinery and its method of operation. In particular, the present invention relates to a ducted impeller system for maximizing thrust at a given rotational speed and at low ratios of forward speed to jet velocity. The concepts of this invention also relate to the operation of a thruster or axial flow pump having a high specific speed per stage.

2. Description of Prior Art

The prior art is best described by briefly setting out the conventional parameters utilized in turbomachinery design. The impeller design will be discussed first.

The ratio of axial speed velocity of fluid exiting a particular piece of turbomachinery, to tip speed, velocity of the turbomachinery impeller blade at its tip, is determined by the blade angle. See generally, Principles of Turbomachinery, Shepard, Macmillan Co. (1965). The angle of an impeller blade at a point along the blade is measured between a tangent to the blade profile or chord line of the point where the angle is to be measured and a reference direction which is usually the tangential direction, FIG. 3 illustrates the blade angles a and $a_2$ at the leading edge 13 and the trailing edge 15 of a blade element 9. As shown in FIG. 3 the blade angle at the leading edge 3, for example, is measured between a tangent 33 to the chord line 17 of the blade element 9 and a reference directional line 37.

Another characteristic of impellers utilized for turbomachinery applications is blade pitch. Referring to FIG. 5, blade pitch is defined by the following equation:

$$\text{pitch} = 2\pi r \tan(\theta+\alpha)$$

where r is the radius from the axis of rotation of the impeller to the section of the blade under consideration. The angle $\theta$, is termed the relative flow angle and $\alpha$, measured from the chord line to the angle $\theta$ is defined as the angle of attack of the blade.

FIG. 5, often referred to as a velocity triangle, illustrates the tangential velocity component $V_t$ and the axial velocity component $V_a$. The resultant velocity being the vector summation of $V_t$ and $V_a$ is shown as $V_r$. The tangental velocity component is defined by the following equation:

$$V_t = \frac{2\pi N}{60} r$$

where r is the radius of the impeller and N is the rotative speed of the impeller. Specific speed is a function of the rotative speed N of the impeller, and the flow rate Q and head H as expressed below:

$$N_s = \frac{N(Q)^{\frac{1}{2}}}{H^{\frac{3}{4}}}$$

As shown in FIG. 6, the efficiency of an impeller blade is a function of the blade pitch to diameter ratio. Thus having determined the blade diameter, the blade pitch may be chosen for maximum efficiency. As blade pitch is a function of the relative flow angle $\theta$ and the angle of attach $\alpha$ {pitch = $2\pi r \tan(\theta+\alpha)$}, once a blade pitch has been chosen for maximum efficiency, the summation of $\theta$ and $\alpha$ is also fixed which in turn defines the velocity triangle as shown in FIG. 5. Knowing the speed and flow and head requirements $V_t$ may be calculated, and $\theta$ and $V_t$ determine $V_a$.

The component $V_a$ is the axial velocity through the impeller.

Two basic approaches have been utilized in order to produce turbomachinery which operates at high efficiency while minimizing the cost expenditure required for the prime mover. One solution has been to operate the impeller of the turbomachinery within a diffuser or shroud throat. The decreased cross-sectional area produced by the diffuser increases the axial velocity component $V_a$. However, such an approach suffers from the disadvantage of producing flow separation and turbulence in the diffuser downstream of the throat. This flow separation and turbulence produces a significant decrease in the thrust developed by the turbomachinery and is particularly serious along the surface of the diffuser and at the impeller hub. Diffusers which expand gradually from the cross-sectional area of the throat reduce flow separation but their length is excessive both in terms of cost and weight and friction losses.

The second approach requires that the routine speed of the turbomachinery be reduced. This reduces the tangential velocity component $V_t$. This approach requires speed reducers as most prime movers are designed to operate at a comparative high speed. Such speed reduction is both expensive and requires equipment which is difficult to maintain. It also requires a large duct and impeller diameter.

DESCRIPTION OF PREFERRED EMBODIMENTS

Figure 1:
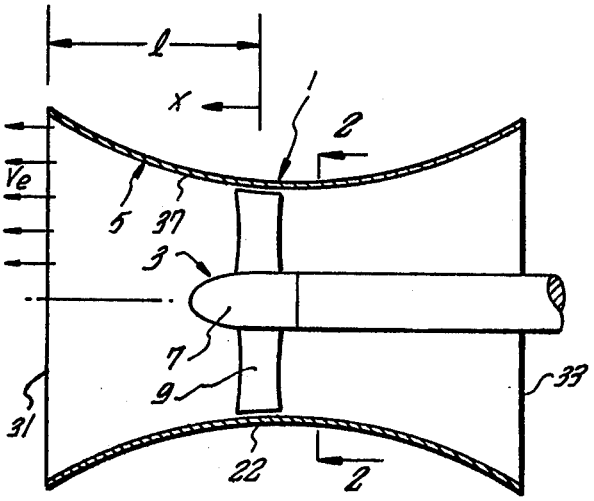
FIG. 1 is a partial cross-section of the thruster of this invention.

Referring to FIG. 1 turbomachinery equipment 1 is shown having an impeller 3 located within a diffuser throat 22. The impeller 3 is comprised of a hub section 7 and at least one impeller blade 9.

Figure 3:
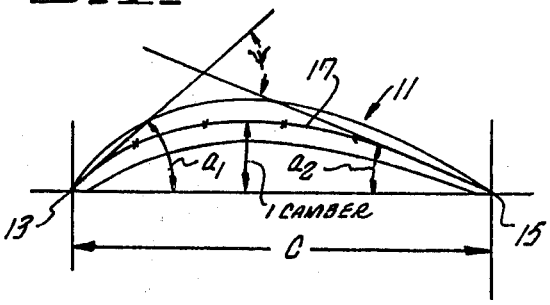
FIG. 3 is a partial cross-section of the present invention.

Referring now to FIG. 3, the traditional blade terminology which is utilized in the description of this invention is set out. The blade profile, or blade section 11, has a leading edge 13 and a trailing edge 15. The blade chord "C" is the distance between the blade leading edge 13 and the trailing edge 15. In one embodiment both the leading and trailing edges 13 and 15 are slightly rounded in order to strengthen the blade and to have a rounded leading edge in reversing. A camber line 17 is shown in FIG. 3 and it represents the axis of linear profile for the blade section. The camber angle, $\psi$, defined as shown in FIG. 3 as representing the total angle through which the base blade profile is disposed from a linear position.

Figure 2:
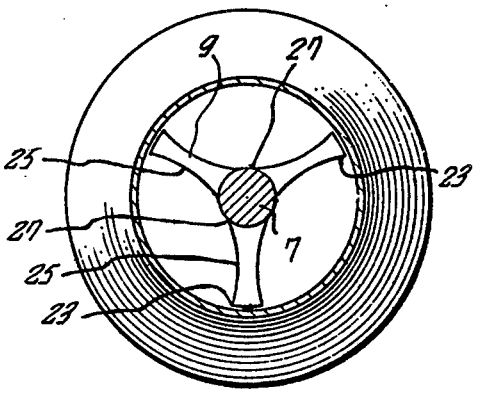
FIG. 2 is a cross-section taken about line 2—2 of FIG. 1.

A description of traditional blade terminology may be continued by reference to FIG. 2 wherein an impeller hub 7 is shown to which a plurality of blade members 9 are mounted. Each blade member is shown in the cross-section of FIG. 2 to have a tip section 23, a root section 27 and a midsection 25.

The diffuser shown in FIG. 1 has a throat section 22 and an outlet section 31. In one embodiment, the diffuser is a venturi having an inlet 33 which has a cross-sectional area substantially identical to the cross-sectional outlet area 31. In one embodiment the ratio areas of the duct exit area 31 and 33 to the throat area is between about 1.3 to about 2.0

The impeller of this invention has impeller blades which are wider at the root 27 and tip 23 than at the midportion 25. This provides for increased pressure head along a wall 37 of the diffuser 5 and the hub 7. The ratio of the pressure head increase at the root 27 and tip sections 23 as contrasted with the pressure head increase at the minimum midsection 25 is between about 1.25 and about 2.25. This increased head increase causes the flow to remain attached to the diffuser and hub walls thereby substantially eliminating flow separation by producing a vorticity shed from the blades due to the widening toward the wall 37, thus serving to assist the fluid flow in remaining adjacent to the diffuser wall 37.

Since, in the practical thruster, the diffuser must be as short as possible, the variation of area with distance x as referenced in FIG. 1 must be optimal to the system. In a preferred embodiment the ratio of areas is defined by the following relationship:

$$\frac{A_x}{A_o} = \left[\left(1 - \left(\frac{A_t}{A_o}\right)^{\frac{n}{2}}\right)\frac{x}{1} + \left(\frac{A_t}{A_o}\right)^{\frac{n}{2}}\right]^{-\frac{2}{n}}$$

Where $A_t$ is the diffuser cross-sectional area at the diffuser throat, $A_o$ is the diffuser cross-sectional area t the outlet, 1 is the diffuser length from the diffuser throat to the diffuser outlet, x is a distance along the diffuser measured from the diffuser throat toward the diffuser outlet, $A_x$ is the diffuser cross-sectional area x distance from the diffuser throat and n is a value between approximately 2 and approximately 4.

The exit velocity at section 31 is made as nearly constant as possible across the section by local pitch adjustments on the blades. This correction process produces impeller blades with decreased head at the center blade region 25. Blade pitch is defined by the following relationship:

$$\text{pitch} = 2\,r\,(\tan\theta + \alpha)$$

where r is the radius to the section of the blade under consideration.

The variation of pitch to blade width or cord C to ensure attached flow in the diffuser and near a constant jet velocity as possible is fundamental to the operation of the thruster of this invention. In the operation in which the thruster is required to work reversibly, the blade section is made symmetrical throughout both its longitudinal and transverse axes. This produces a blade 9 with substantially zero camber angle $\psi$ and one which is symmetrical about an axis which is perpendicular to the chord line at its midpoint. Preferably, the duct is also made to have the same area expansion rate in both directions as defined by the foregoing equation relating to area relationships and the blade camber is approximately zero.

Figure 4:
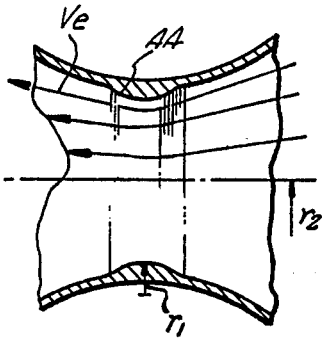
FIG. 4 is a partial cross-section of the present invention.
Figure 5:
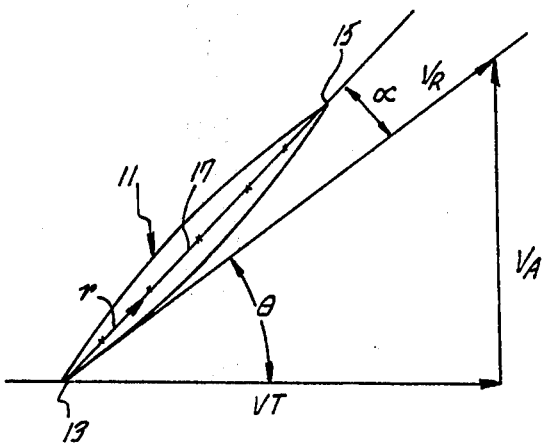
FIG. 5 is a turbomachinery velocity triangle.
Figure 6:
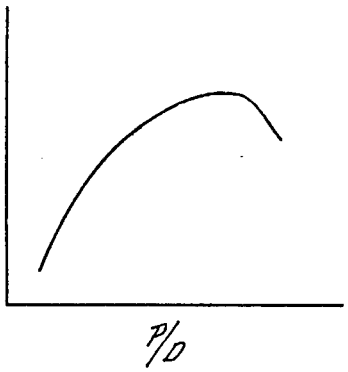
FIG. 6 is a plot of turbomachinery efficiency as a function of impeller pitch to diameter ratio.

A further feature of this invention relates to the speed-up of the axial component of the velocity near the outer wall throat region due to curvature of the wall as shown in FIG. 4. The velocity profile of FIG. 5 dramatically shows how the velocity is greater near the curved wall. The boundary layer effect is small in this region and can be substantially neglected with respect to turbomachinery flow rate consideration. In accordance with this invention, this effect is enhanced by a curvilinear surface 44 at the wall of the throat, the curvilinear surface having a radius of curvature extending through an arc of between about 15 and about 45 degrees upstream and downstream of the venturi throat. Further, the venturi outlet cross-sectional area may be about 1.3 to about 2.0 times as great as the throat cross-sectional area. The configuration permits steeper blade angles near the tips where for nearly constant pitch they tend to be flatter.

Such a curvilinear surface 44 at the venturi throat allows for the blades to be substantially flat. Such a relationship allows for a large radial extent inward from the blade tip, the axial velocity component $V_a$ and the tangential velocity component $V_t$ to be approximately proportional to the blade radius as measured outward from the axis of rotation. A large curvature at the throat 22 would normally cause the flow to separate along this region were it not for the presence of the impeller 3 and the vorticity shed produced by the blades 9 having a configuration of the type previously described in this invention. Operation of the hourglass-shaped blades 9 and the curvilinear throat portion 44 allows for substantial gains in thruster performance over a range of specific speeds from 10,000 to 100,000. The ratio of the radius of the curvilinear surface $r_1$ to the radius of the impeller $r_2$ is preferably less than about 1.0 and greater than about 1/5.

Having described this invention in detail, it is understood that modifications obvious to those skilled in the art may be made to this invention without departing from the scope of the appended claims which follow.

I claim:

1. A method of operating turbomachinery having an impeller with a plurality of blades mounted about a central rotatable hub, said impeller being positioned within a diffuser and adjacent the diffuser throat comprising:

imparting an increased pressure head at the blade tip and root sections as constrasted with the pressure head imparted at the blade midsection.

2. A method of operating turbomachinery as claimed in claim 1 wherein the ratio between the pressure head at the impeller tip and root section and the pressure head at the blade midsection is between about 1.25 and about 2.25.

3. A method of operating turbomachinery as claimed in claim 1 wherein said method further comprises:

rotating said impeller at an equivalent specific speed of between approximately 10,000 and 100,000.

4. A method of operating turbomachinery as claimed in claim 3 wherein the angle of attack of the rotating impeller blades is between approximately 2 degrees and approximatly 7 degrees.

5. A method of operating turbomachinery having an impeller with a plurality of blades mounted about a central rotatable hub, said impeller being positioned within a venturi comprising a throat region located between two diffusers, imparting an increased pressure head at the blade tip and root sections as contrasted with the pressure head imparted at the blade midsection;

rotating said impeller at an effective specific speed of about 10,000 to 100,000, the attack angle of said rotating impeller blades being between approximately 2 degrees and approximately 7 degrees.

6. A method of operating reversible turbomachinery having an impeller positioned within a venturi, the impeller having a plurality of fixed blades with a camber which is substantially zero and being substantially symmetrical about an axis perpendicular to the blade chord line at its midpoint comprising:

imparting an increased pressure head at the blade tip and root sections as contrasted with the pressure head imparted at the blade midsection;

producing an axial velocity component and a relative tangental velocity component which are both directly proportional to the distance measured outward along the blade from the blade root.

7. A method of operating reversible turbomachinery as claimed in claim 6 wherein said method further comprises:

rotating said impeller at an effective specific speed of between approximately 10,000 and 100,000.

8. A method of operating reversible turbomachinery as claimed in claim 7 wherein said impeller is rotated such that the attack angle is between approximately 2 degrees and approximately seven degrees.

9. A method of operating reversible turbomachinery having an impeller positioned within a venturi throat, the impeller having a plurality of fixed blades with a camber which is substantially zero and the blades being substantially symmmetrical about an axis perpendicular to the blade chord line at its midpoint, comprising:

(generating) a blade pressure head profile such that the ratio of the pressure head at the blade tip and root sections as contrasted with the pressure head imparted at the blade midsection is between approximately 1.25 and about 2.25;

producing an axial velocity component and a relative tangental velocity component which are both directly proportional to the distance measured along the blade length from the blade root toward the blade tip;

and rotating said impeller at an effective specific speed of between approximately 10,000 and approximately 100,000 with the attack angle of the impeller blades between approximately three degrees and approximately seven degrees.

* * * * *